US006389616B1

(12) United States Patent
Mussa

(10) Patent No.: US 6,389,616 B1
(45) Date of Patent: May 21, 2002

(54) SWIMMING POOLS FOR COURTYARDS, GARDENS OR FREE SPACES IN DWELLINGS

(76) Inventor: Eduardo Alberto Mussa, Avda. Illia 1715, 1661 Bella Vista, Buenos Aires (AR)

( * ) Notice: Subject to any disclaimer, the term of this patent is extended or adjusted under 35 U.S.C. 154(b) by 0 days.

(21) Appl. No.: 09/776,692

(22) Filed: Feb. 6, 2001

(51) Int. Cl.[7] ..... E04H 4/00
(52) U.S. Cl. ..... 4/506
(58) Field of Search ..... 4/506, 488; 52/169.7

(56) References Cited

U.S. PATENT DOCUMENTS 4,597,113 A * 7/1986 Eymard ..... 4/506 X
4,782,538 A * 11/1988 Chisholm et al. ..... 4/506
5,083,327 A * 1/1992 Gillebrand ..... 4/506
5,592,702 A * 1/1997 Gillebrand, Jr. ..... 4/506

* cited by examiner

*Primary Examiner*—Charles E. Phillips
(74) *Attorney, Agent, or Firm*—Jacobson Holman, PLLC

(57) ABSTRACT

The present invention relates to improvements in swimming pools or other impoundments (hereinafter, "swimming pools"), for use in patios, gardens, open spaces, and around homes, which have an upper frame that supports a membrane which contains the contents of the pool, which upper frame is connected to support legs. The bottom of the pool has extensions or strips which are bent into a loop to engage a crossbar or other engaging member at the foot of each said leg and one of the lateral walls of the pool contains an annular laminar insert which extends radially from a tubular projecting member which has a double wall which defines a space in which a lateral wall of a plug is compressively engaged, which plug is connected via a laminar strip to the annular laminar insert, wherewith said plug also has a double wall which defines an annular recess, and wherewith the internal surface of the said cylindrical space or said cylindrical recess bears a ridge which extends around the entire circumferential extent of said surface. The strips may have a variety of configurations.

7 Claims, 2 Drawing Sheets

SWIMMING POOLS FOR COURTYARDS, GARDENS OR FREE SPACES IN DWELLINGS

BACKGROUND OF THE INVENTION

1. Field of the Invention

The present invention relates to an improvement in swimming pools or other impoundments (hereinafter, "swimming pools"), for use in patios, gardens, open spaces, around homes. More specifically, the present invention relates to swimming pools comprised of canvas or similar material (hereinafter, "membrane"), which are easily assembled or disassembled, and in particular comprise a tubular structure which can be disassembled. This tubular structure serves as support and is connected to the edge regions (or edge loops) of the membrane. The membrane defines the space for containing the water.

2. Description of the Related Art

Swimming pools comprised of membranes of various materials (e.g. canvas or plastic), can be erected rapidly in a patio or garden, and have come into widespread use because they allow one to make effective use of a space without suffering major modification of that space.

These swimming pools are generally comprised of a tubular structure which defines an upper and lower frame of the pool. The upper and lower frames are comprised of small tubes for coupling the lateral legs of the pool which legs will ultimately support the membrane. The overall structure is designed such that it can be readily assembled and disassembled.

Whereas the tubular structures utilized heretofore do indeed satisfy the principle purpose intended, they have the drawback that, being comprised of a plurality of tube segments which form the upper and lower frame substructures, they occupy too much space to be commercialized, and are costly due to the large number of pieces of which they are comprised. Another drawback of the known structures is that in order to empty them one must employ an external hose and a pump.

SUMMARY OF THE INVENTION

The proposed invention has as its principal objects improvements in the supporting structure of a membrane-type swimming pool and a means of fixing the generally flexible profiled enclosure of the water to the legs which support the upper tubular framework of the structure and outlet device having a closure plug.

Another object of the present invention is a means of incorporating, in the lateral walls of the generally flexible profiled enclosure of the space containing the water, a series of extensions, tabs, strips, or straps (hereinafter collectively "extensions or strips") which serve as supporting elements for the lateral legs of the structure, in instances where the rigid frame consists only of an upper framework and legs. A further object of the present invention is to provide an outlet device which forms a part of the membrane.

Still other objects of the invention are to provide a means whereby, once the structure of the swimming pool has been erected, the walls (i.e., of the frame and the membrane) provide improved support for the pool and the contents and means of rapidly and easily connecting an outlet hose to the pool.

The present invention also proposes improvements in swimming pools of the types described, which improvements consist of incorporating, in the lateral walls of the membrane, at or contiguous to the bottom expanse of the membrane, a means of fixing each such wall to the tubular legs, to provide improved support of the structure, thus dispensing with a bottom frame (or in cases where there is no bottom frame).

Another object of the proposed invention is to provide a system for rapidly and easily coupling the water outlet hose. The described coupling means is in the form of a piece of plastic material which is integrally incorporated into one of the lateral walls of the swimming pool and which has an articulated plug which allows one to empty the swimming pool easily and quickly, through a large outlet flow aperature.

Finally, the present invention provides a dismountable swimming pool of low cost, which is achieved by way of a lesser number of tubular pieces, enabling easier and less expensive packaging of the product for sale, and facilitating compact storage during cold periods.

DETAILED DESCRIPTION OF THE EMBODIMENTS OF THE INVENTION

Figure 1:
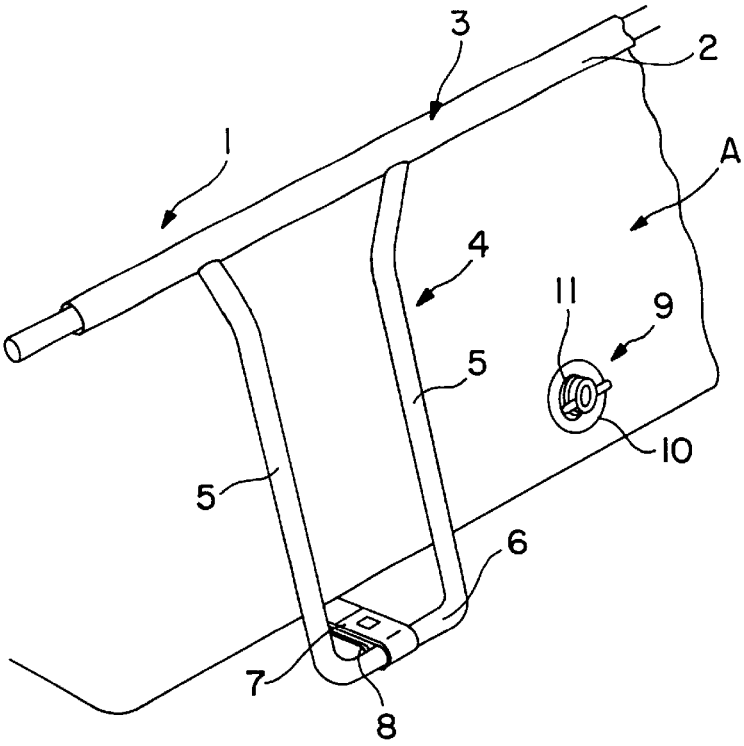
FIG. 1 is a perspective schematic view of a portion of a structure embodying the improvements to the wall of a swimming pool.

As illustrated in the drawings, and in particular with reference to FIG. 1, the improvement in swimming pools or other impoundments according to the present invention has been incorporated in a support structure 1 comprised of upper beams 3 which are in turn comprised of the upper frame element 2 of the structure 1, wherewith a plurality of leg members 4 spaced equidistantly extend from said frame element 2, each of which leg members 4 comprises laterally disposed tubular leg elements 5 and a foot member 6 (lower crossbar of the leg member 4) to which foot member 6 a strip 7 with end loop 8 is attached, wherewith the strips 7 are supported by the bottom membrane component of the swimming pool A, and wherewith on one of the lateral membrane walls of the swimming pool A an outlet device 9 is provided which is fixed to said membrane by heat welding or similar means and which is comprised of a laminar portion in the form of an annular piece 10 which surrounds a tubular (nipple-like) portion 11.

Figure 2:
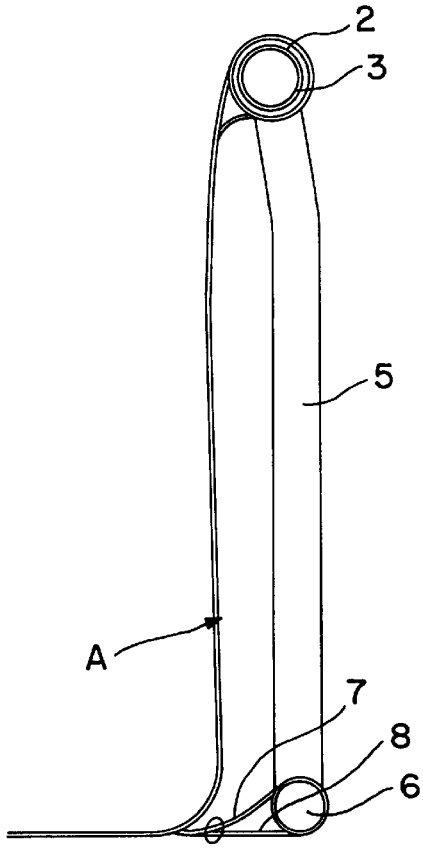
FIG. 2 is a cross sectional elevation view of one of the extensions or strips fixed to the bottom of the swimming pool.

FIG. 2 is a cross-sectional view of one of the extensions or strips 7 possessing an upper frame element 2 and upper beams 3 where each extension or strip 7 with an end loop 8 attaches to the lower crossbar of one of the foot member 6 connecting the leg elements 5 to the swimming pool A.

Figure 3:
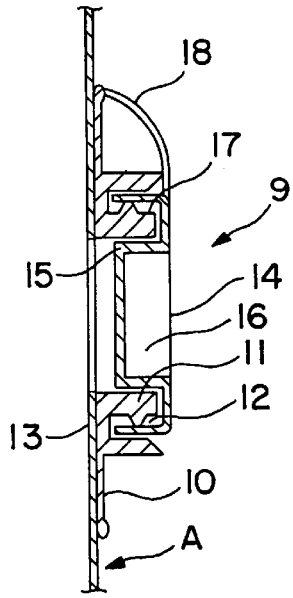
FIG. 3 is a cross sectional elevation view of the device which is integrally fixed to the wall of the swimming pool to enable easy and quick coupling of an outlet hose.

FIG. 3 has an annular protrusion 12 which has a ridge 13 projecting from the circumference of its internal surfaces for the entire circumferential extent of said surface. The ridge serves to compressively hold a cylindrical outer edge member of a plug 14 which edge member, in conjunction with the lateral wall 15 of a central recess 16 of the plug 14, defines an annular groove 17 which compressively attached onto the annular protrusion whereby the plug 14 is connected to a strip 18 which connects the plug to the annular piece 10.

Figure 4A:
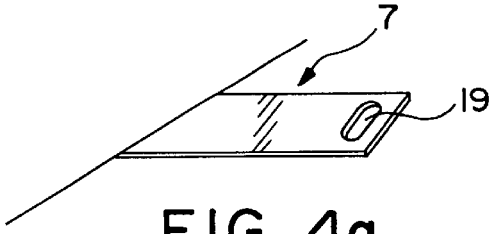
FIGS. 4*a* through 4*g* are perspective partial-detail views of various possible embodiments of the fixing extension or fixing strip, for engaging the legs, which extension or strip is a principal subject of the present improvement.
Figure 4B:
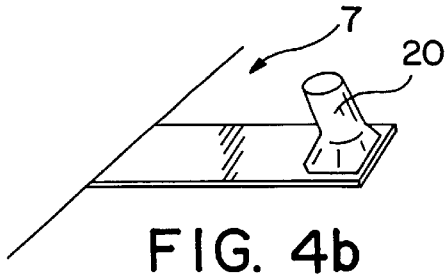

FIGS. 4*a* to 4*g* illustrate schematically various possible embodiments of the strips 4, which are offered as examples:

FIG. 4*a* shows a strip 7 with a transverse oblong opening 19;

FIG. 4*b* shows a strip 7 which has a tubular projection 20 on its end region, which projection engages around the foot member 6 of the lateral branch leg elements 5.

Figure 4C:
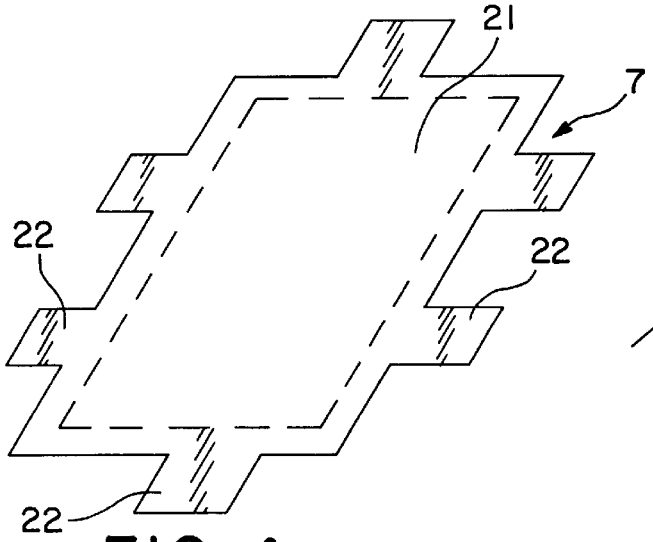

FIG. 4*c* shows the strip 7 configured as a second bottom 21 affixed to the main bottom membrane on the underside thereof, which bottom 21 has lateral lug projections 22.

Figure 4D:
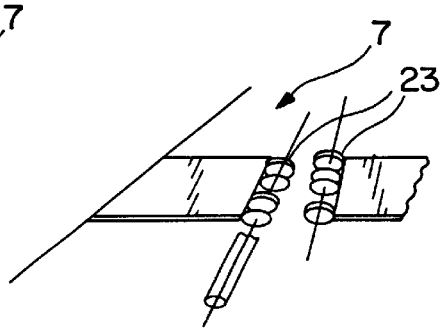

FIG. 4*d* shows the strip 7 having a hinge joint 23 which can be disassembled.

Figure 4E:
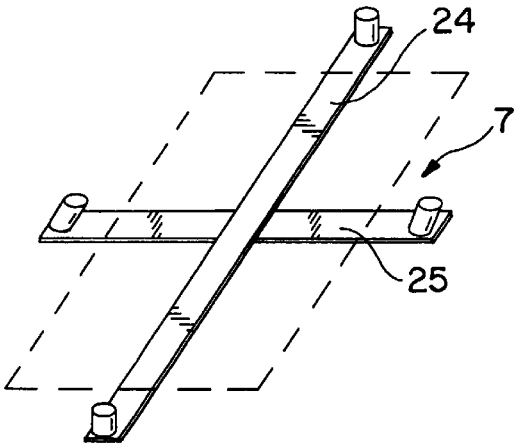

FIG. 4*e* shows strips 7 in the form of longitudinal 24 and transverse strips 25 which define an orthogonal grid at the bottom of (or underneath) the swimming pool.

Figure 4F:
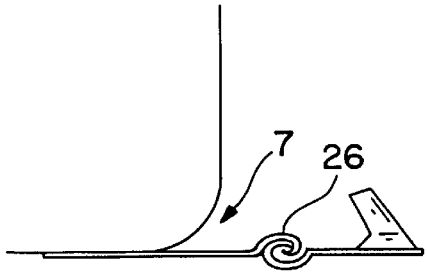

FIG. 4*f* shows two members having a curved shape interconnection 26 which connect the two members of a strip 7.

Figure 4G:
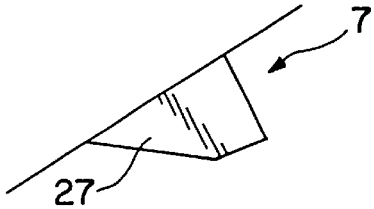

FIG. 4*g* shows strips 7 which have an irregular trapezoidal configuration. 27

Having fully described the invention, it will be apparent to one of ordinary skill in the art that changes and modifications can be made thereto without departing from the spirit or scope of the invention as set forth herein.

I claim:

1. An improvement in swimming pools, for use in patios, gardens, open spaces, and around homes, wherein the improvement comprises a tubular structure comprised of an upper frame which supports a membrane that contains the contents of the pool;

lateral support legs for said upper frame extending down to the bottom of the pool and having cross bars;

strips associated with corresponding crossbars;

each strip has a free end and a loop which extends around said crossbar whereby the strips maintain the lateral support legs in substantially vertical relationship to support the membrane;

one lateral wall of the membrane contains a tubular member connected to said wall and having a plug which compressively engages with an annular groove in the tubular member whereby the contents of the pool may be emptied.

2. The improvement in swimming pools according to claim 1, where said end region of the strip has an oblong opening.

3. The improvement in swimming pools according to claim 1, where said strip has a tubular projection on its end region.

4. The improvement in swimming pools according to claim 1, where said strip is an integral member of a rectangular sheet forming the bottom of or a layer of the bottom of the swimming pool.

5. The improvements in swimming pools according to claim 1, where said strip is comprised of two segments bearing hinge elements to enable elongation of the strip.

6. The improvement in swimming pools according to claim 1, where said strip is comprised of segments of predetermined length which are interconnected by means having a hook profile.

7. The improvement in swimming pools according to claim 1 where said extension or strip has an irregular trapezoidal contour.

* * * * *